US006639343B2

(12) United States Patent
Takahashi et al.

(10) Patent No.: US 6,639,343 B2
(45) Date of Patent: Oct. 28, 2003

(54) MERCURY-FREE METAL HALIDE LAMP

(75) Inventors: Kiyoshi Takahashi, Hirakata (JP); Yuriko Kaneko, Nara (JP); Hideaki Kiryu, Takatsuki (JP); Masato Yoshida, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 106 days.

(21) Appl. No.: 09/904,036

(22) Filed: Jul. 12, 2001

(65) Prior Publication Data

US 2002/0021067 A1 Feb. 21, 2002

(30) Foreign Application Priority Data

Jul. 14, 2000 (JP) ..... 2000-214047

(51) Int. Cl.[7] ..... H01J 1/50; H01J 61/18

(52) U.S. Cl. ..... 313/161; 313/153; 313/156; 313/484; 313/494; 313/567; 313/568; 313/574; 313/576; 313/637; 313/638; 315/358

(58) Field of Search ..... 313/638, 161, 313/160, 156, 637, 343, 570, 623, 484, 494, 153, 155, 154, 567, 569, 572, 574, 576, 620; 315/248, 344, 246, 363, 637, 358, 307

(56) References Cited

U.S. PATENT DOCUMENTS 6,069,456 A 5/2000 Fromm et al.

FOREIGN PATENT DOCUMENTS

| | | | |
|---|---|---|---|
| EP | 0 883 160 | A1 | 9/1998 |
| EP | 0 883 160 | A1 | 12/1998 |
| EP | 0 942 454 | A2 | 9/1999 |
| JP | 55086062 | A | 6/1980 |
| JP | 06162994 | A | 6/1994 |
| JP | 09161725 | A | 6/1997 |
| JP | 09283086 | A | 10/1997 |
| JP | 11066927 | A | 3/1999 |
| JP | 11307048 | A | 11/1999 |
| JP | 11317103 | A | 11/1999 |
| JP | 2000090880 | A | 3/2000 |
| JP | 2000182564 | A | 6/2000 |
| JP | 2001006610 | A | 1/2001 |
| JP | 2001076670 | A | 3/2001 |

*Primary Examiner*—Ashok Patel
*Assistant Examiner*—Sharlene Leurig
(74) *Attorney, Agent, or Firm*—Harness, Dickey & Pierce, P.L.C.

(57) ABSTRACT

A mercury-free metal halide lamp includes an arc tube including a pair of electrodes inside the tube. In the arc tube, a rare gas and a metal halide are contained, and no mercury is contained. The mercury-free metal halide lamp is horizontally operated such that the pair of electrodes is substantially horizontal. The mercury-free metal halide lamp further includes magnetic field applying means for applying a magnetic field including a component substantially perpendicular to a straight line connecting heads of the pair of electrodes in a substantially vertical direction. The density of halogen atoms evaporated during steady-state operation with respect to unit inner volume of the arc tube is 20 μmol/cc or more.

5 Claims, 7 Drawing Sheets

MERCURY-FREE METAL HALIDE LAMP

BACKGROUND OF THE INVENTION

The present invention relates to mercury-free metal halide lamps that do not contain mercury as a luminous material. In particular, the present invention relates to mercury-free metal halide lamps used for headlights of automobiles in combination with a reflecting mirror.

In recent years, metal halide lamps, which are one type of discharge lamps have been developed vigorously. The metal halide lamps enclose metal halide, in addition to mercury, in an arc tube (bulb) as luminous materials, and for example, the metal halide lamps are beginning to be used as head lamps of automobiles.

FIG. 7 shows a conventional metal halide lamp. The metal halide lamp shown in FIG. 7 includes the arc tube 1 made of quartz glass and sealing portions 2 for sealing the inside of the arc tube 1 that are positioned at both ends of the arc tube 1. A pair of electrodes 3 made of tungsten is arranged in the arc tube 1. A luminous material 17 including mercury and metal halide and a rare gas (not shown) are enclosed in the arc tube 1. The pair of electrodes 3 in the arc tube 1 is connected to first ends of molybdenum foils 4, and the molybdenum foils are sealed by the sealing portions 2. The other (second) ends of the molybdenum foils 4 are connected to lead wires 5. The lead wires 5 are electrically connected to an operating circuit (not shown).

The principle of the emission of this metal halide lamp will be described briefly. When the lamp is operated by applying a voltage to the lead wires 5 from the operating circuit, the metal halide (17) is partially or entirely evaporated, and then arc discharge generated between the pair of electrodes 3 causes dissociation between metal atoms and halogen atoms, and thus excitation and emission of the metal atoms occurs. In the vicinity of the tube wall of the arc tube 1, the dissociated metal atoms are recombined with halogen atoms to return to the metal halide. The lamp stays on stably by repeating this cycle phenomenon. In general, although the metal halide has a lower vapor pressure than that of mercury, the metal halide is readily excited and emits. Therefore, in the metal halide lamp, the emission of the added metal tends to be stronger than that of mercury. Therefore, the mercury mainly serves as a buffer gas for determining the voltage of the inside of the arc tube 1. The rare gas in the arc tube 1 serves as a start-up gas.

In these days, environmental issues are regarded as important issues to be tackled, so that a mercury-free metal halide lamp containing no mercury is desired in view of the global environment protection when it is disposed of. With this demand, development of mercury-free metal halide lamps has started, but mercury-free metal halide lamps having excellent characteristics have not been developed yet at present.

We made research to develop mercury-free metal halide lamps having excellent characteristics, and found during their pursuit for the development that the following phenomenon occurs. That is, when mercury-free metal halide lamps are operated horizontally, the arc significantly curves upward, compared with when metal halide lamps including mercury are horizontally operated. As a result, the upper portion of the arc tube is heated more than necessary, so that devitrification of the arc tube occurs.

Then, when a magnetic filed is applied to the mercury-free metal halide lamps to suppress the arc curving, the arc curving can be suppressed. However, the method for applying a magnetic field and the principle of curving suppression are different from those for the lamps containing mercury. Magnetic fields at certain intensities may cause the arc itself to become unstable and the arc to vibrate, although arc curving can be suppressed. This arc vibration is not preferable, because flickering is caused when the lamp is actually used.

In order to suppress arc vibration, we made various examinations and succeeded in suppressing arc curving and arc vibration by setting the parameters of the intensity (B) of a magnetic field applied to the center between the electrodes heads, the distance (d) between the heads of a pair of electrodes, the pressure ($P_0$) inside the arc tube during steady-state operation (or the pressure (P) of an enclosed rare gas at 20° C.), the power (w) consumed during steady-state operation, and the steady-state frequency (f) during steady-state operation so as to satisfy a certain relationship. The principle on which arc curving and arc vibration can be suppressed by applying a magnetic field is not clear at present. The relationship to be satisfied by the parameters to suppress arc curving and arc vibration is described in detail in Japanese Patent Application No. 2001-155385 (Applicant; Matsushita Electric Industrial Co., Ltd.), which is incorporated herein by reference.

Thus, a mercury-free metal halide lamp in which devitrification of the arc tube was prevented and flickering was suppressed was successfully realized by the success of suppression of arc curving while arc vibration was suppressed. However, it was observed in the experiments by the inventors of the present invention that in this mercury-free metal halide lamp, although devitrification can be prevented, blackening proceeds in the arc tube. Therefore, even if devitrification of the arc tube can be prevented by the above-described technique, if blackening proceeds, the lamp characteristics are degraded, and the lamp life is reduced. Therefore, practical use of the mercury-free metal halide lamps is still difficult.

SUMMARY OF THE INVENTION

Therefore, with the foregoing in mind, it is a main object of the present invention to provide a mercury-free metal halide lamp in which blackening occurring in the arc tube is effectively suppressed from proceeding.

A mercury-free metal halide lamp of the present invention includes an arc tube including a pair of electrodes inside the tube, wherein in the arc tube, a rare gas and a metal halide are contained, and no mercury is contained, and the mercury-free metal halide lamp is horizontally operated such that the pair of electrodes is substantially horizontal. The mercury-free metal halide lamp further includes magnetic field applying means for applying a magnetic field including a component substantially perpendicular to a straight line connecting the heads of the pair of electrodes in a substantially vertical direction, wherein the density of halogen atoms evaporated during steady-state operation with respect to unit inner volume of the arc tube is 20 $\mu$mol/cc or more.

It is preferable that the density of the halogen atoms is 40 $\mu$mol/cc or more.

It is preferable that the total amount of the metal halide enclosed in the arc tube with respect to unit inner volume of the arc tube is 20 $\mu$mol/cc or more.

It is preferable that the total amount of the metal halide enclosed in the arc tube with respect to unit inner volume of the arc tube is 120 $\mu$mol/cc or less.

The present invention is provided with magnetic field applying means for applying a magnetic field including a component substantially perpendicular to a straight line connecting the heads of the pair of electrodes in the substantially vertical direction, and the density of the halogen atoms evaporated during steady-state operation with respect to unit inner volume of the arc tube is 20 μmol/cc or more. Therefore, blackening occurring in the arc tube effectively can be suppressed from proceeding. Furthermore, when the total amount of the metal halogen is 120 μmol/cc or less, a lamp in which optical transmission loss by metal halide enclosed in the arc tube is suppressed can be realized.

This and other advantages of the present invention will become apparent to those skilled in the art upon reading and understanding the following detailed description with reference to the accompanying figures.

DETAILED DESCRIPTION OF THE INVENTION

Figure 1:
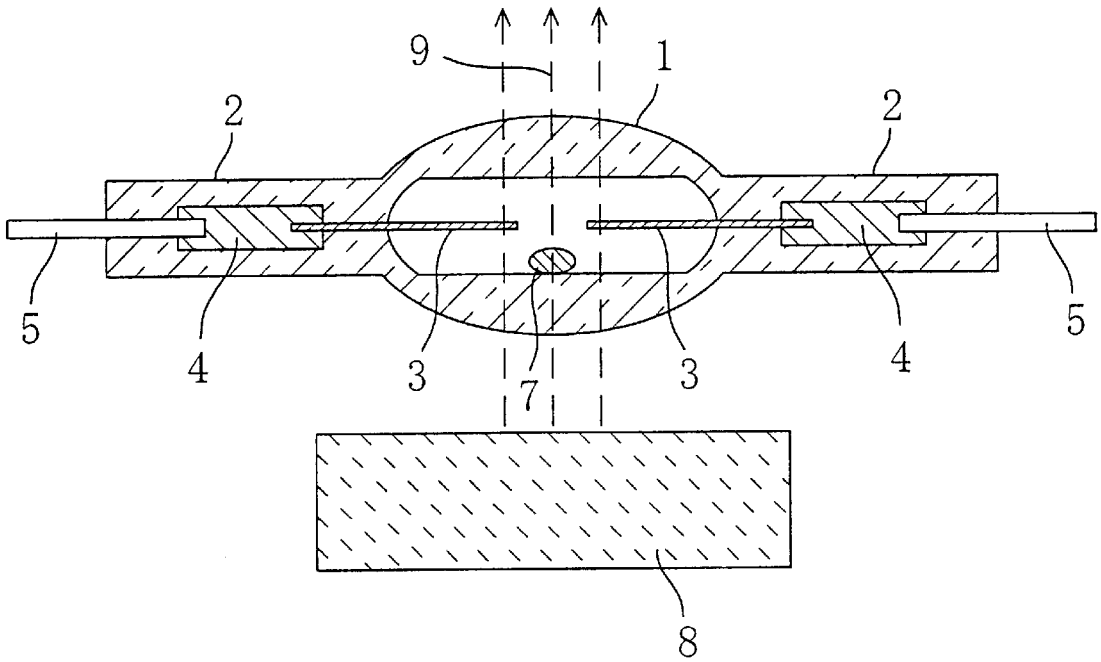
FIG. 1 is a schematic cross-sectional view showing the configuration of a mercury-free metal halide lamp of an embodiment of the present invention.

The inventors of the present invention made in-depth study to suppress blackening from proceeding in mercury-free metal halide lamps, and found that blackening can be suppressed from proceeding by setting the density of halogen atoms produced by evaporation of metal halide enclosed in the arc tube during steady-state operation to a predetermined value or more, and thus attained the present invention.

Hereinafter, embodiments of the present invention will be described with reference to the accompanying drawings. For simplification, elements having substantially the same function bear the same reference numeral. The present invention is not limited to the following embodiments.

FIG. 1 is a schematic cross-sectional configuration of a mercury-free metal halide lamp of an embodiment of the present invention.

The lamp shown in FIG. 1 includes an arc tube (bulb) 1 having a pair of electrodes (3,3) opposed to each other inside the tube. In the arc tube 1, a rare gas and a metal halide 7 are contained. However, mercury is not contained therein. In other words, the lamp of this embodiment is a mercury-free metal halide lamp.

Figure 2:
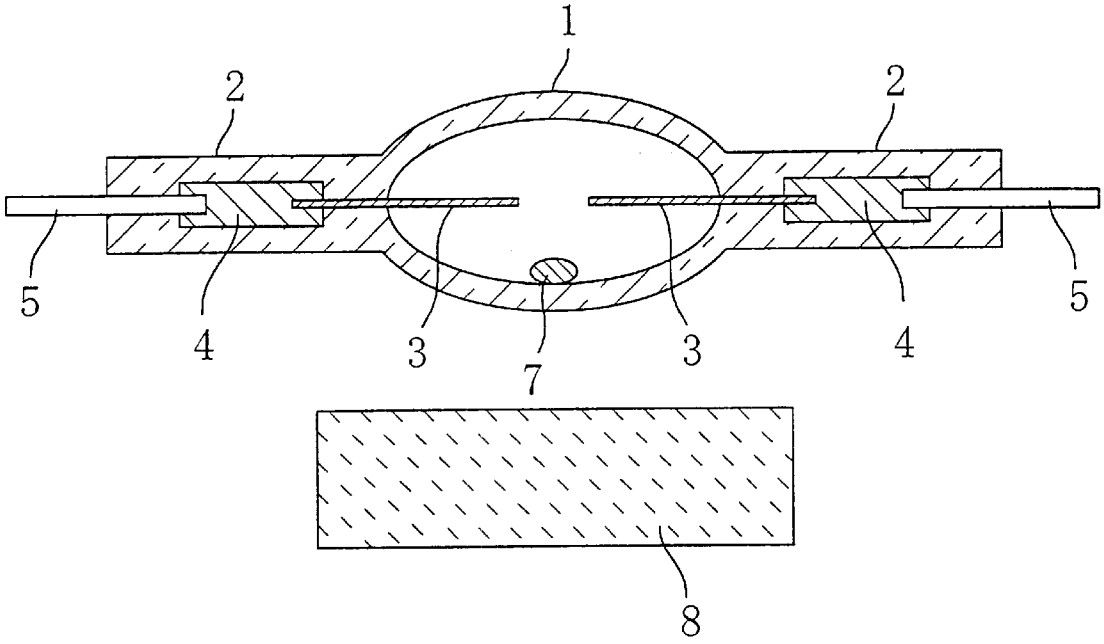
FIG. 2 is a cross-sectional view showing a variation of the mercury-free metal halide lamp shown in FIG. 1.

The arc tube 1 is made of, for example, quartz glass, and the inside thereof has a substantially cylindrical shape. In this embodiment, Xe (xenon) is enclosed in the arc tube 1 at about 1.4 MPa at room temperature as a rare gas. The metal halide 7 is enclosed in the arc tube 1 such that the density of evaporated halogen atoms during steady-state operation is 20 μmol/cc or more. More specifically, in this embodiment, the density of evaporated halogen atoms during steady-state operation with respect to unit inner volume of the arc tube 1 is 20 μmol/cc or more. In the configuration shown in FIG. 1, the inside of the arc tube 1 has a substantially cylindrical shape, but as shown in FIG. 2, the shape may be substantially spherical.

A pair of sealing portions (2,2) to achieve airtightness of the arc tube 1 extends from the arc tube 1. The electrodes 3 are connected to lead wires 5 made of molybdenum via metal foils 4 in the sealing portions 2. In other words, the electrodes 3 are electrically connected to first ends of the molybdenum foils 4 sealed by the sealing portions 2, and electrically connected to the lead wires 5 connected to the other (second) ends of the molybdenum foils 4.

The lamp of this embodiment is operated (horizontally operated) such that a straight line connecting the heads of the pair of electrodes (3,3) is substantially horizontal, and further is provided with magnetic field applying means 8 for applying a magnetic field 9 including a component substantially perpendicular to the straight line in a substantially vertical direction. This magnetic field applying means 8 can apply the magnetic field 9 to the arc generated between the electrodes. The magnetic field applying means 8 of the present embodiment is a permanent magnet (e.g., a ferrite magnet), and the permanent magnet 8 is attached below the lamp (below the arc tube 1). The permanent magnet 8 can be attached above the lamp (above the arc tube 1). The N pole and the S pole of the permanent magnet 8 can be reversed. Two permanent magnets 8 can be provided above and below the arc tube 1.

The permanent magnet 8 in the configuration shown in FIG. 1 is an isotropic ferrite magnet, has a diameter of 10 mm and a thickness of 5 mm, and is disposed about 10 mm away from the central point on the straight line connecting the electrodes. The magnetic field 9 on this central point is oriented substantially in a vertically upward direction, and the magnetic flux density B applied to the midpoint of the straight line connecting the electrode heads is about 5 mT.

The inventors of the present invention used varied types and amounts of the metal halide 7 in the configuration shown in FIG. 1 to produce mercury-free metal halide lamps (lamps 1 to 7) with varied densities of halogen atoms generated by evaporation from the enclosed metal halide 7 during steady-state operation. Table 1 below shows the constitution of the metal halide 7 of each lamp. In Table 1, the upper line of each cell indicates the amount (μmol) of the enclosed metal halide 7, and the lower line indicates the density (μmol/cc) of the halogen atoms (I) that are generated by evaporation.

TABLE 1

| Lamp No. | 1 | 2 | 3 | 4 | 5 | 6 | 7 | Com. Ex. |
|---|---|---|---|---|---|---|---|---|
| $InI_3$(μmol):n1 | 0.2 | 0.4 | 0.4 | 0.2 | | 0.1 | | |
| (μmol/cc) | 8 | 16 | 16 | 8 | | 4 | | |
| InI(μmol):n2 | | | | | 0.8 | | | 0.8 |
| (μmol/cc) | | | | | 32 | | | 32 |
| TlI(μmol):n3 | 0.3 | | 0.3 | 0.3 | | 0.2 | | |
| (μmol/cc) | 12 | | 12 | 12 | | 8 | | |
| $ScI_3$(μmol):n4 | 0.14 | 0.4 | 0.4 | 0.4 | 0.4 | | 0.4 | 0.4 |
| (μmol/cc) | 5.6 | 16 | 16 | 16 | 16 | | 16 | 16 |
| NaI(μmol):n5 | 0.3 | 1.1 | 1.1 | 1.1 | 1.1 | | 1.1 | 1.3 |
| (μmol/cc) | 12 | 44 | 44 | 44 | 44 | | 44 | 52 |
| Metal halide | | | | | | | | |

TABLE 1-continued

| Lamp No. | 1 | 2 | 3 | 4 | 5 | 6 | 7 | Com. Ex. |
|---|---|---|---|---|---|---|---|---|
| Total: C = (μmol) | 0.94 | 1.9 | 2.2 | 2 | 2.3 | 0.3 | 1.5 | 2.5 |
| (μmol/cc) | 37.6 | 76 | 88 | 80 | 92 | 20 | 60 | 100 |

The common specifications to the lamps in Table 1 are as follows:
Inner diameter of the arc tube 1: D = about 2.7 mm
Length of the arc tube in the electrode axis direction: about 4 (mm)
Inner volume: about 0.025 (cc)
Inner surface area: S = 50 ($mm^2$)
Inner volume: V = 0.025 (cc)
Distance between the electrodes: d = about 4.2 (mm)
Diameter of the electrode head: Φ = 0.25 (mm)
Rated power: W = 35 (W)
Rated current: I = about 0.6 (A)
Rated power per unit inner surface area of the arc tube: A = 50 ($W/cm^2$)

Furthermore, as a comparative example, a conventional metal halide lamp containing mercury also was produced. The lamp of the comparative example is different from the lamp of this embodiment in that mercury is enclosed, the type and amount of the enclosed material are different, and the magnet 8 is not provided. Other than those aspects, the comparative example has the same configuration as that of this embodiment of FIG. 1. Specific types and amounts of the enclosed material of the lamp of the comparative example are as follows: 3.3 μmol of Hg (mercury), and as metal halides, 0.4 μmol of $ScI_3$, 3 wt % with respect to $ScI_3$ of a Sc (scandium) single substance, 1.3 μmol of NaI, and 0.8 μmol of InI. The lamp of the comparative example also is shown in Table 1.

Next, a method for calculating the density of evaporated halogen atoms with respect to the inner volume of the arc tube when each lamp (lamps 1 to 7) is horizontally operated at a rated power of 35 W will be described.

It is known that the enclosed metal halide aggregates in the vicinity of the coolest point having the lowest temperature in the arc tube 1. In the case where a general arc tube having a substantially spherical or substantially cylindrical shape is horizontally operated, the coolest point is in the center of the lower portion of the arc tube. General metal halide lamps are designed to have a temperature at the coolest point of about 900° C., and the temperature at the coolest point of all the lamps in Table 1 is about 900° C. Therefore, the metal halide 7 is evaporated in an amount corresponding to the vapor pressure at 900° C. However, when the metal halide is not enclosed in a sufficient amount to reach the vapor pressure at 900° C. The enclosed metal halide 7 is entirely evaporated.

In view of above, taking the lamp 1 of Table 1 as an example, a method for calculating how much of the metal halide 7 is evaporated and a method for calculating the density of the evaporated metal halide atoms based on these results will be described.

The vapor pressure of $InI_3$ at 900° C. is represented by VP ($InI_3$), and similarly, the vapor pressures of TlI, $ScI_3$, and NaI at 900° C. are represented by VP (TlI), VP ($ScI_3$) and VP (NaI), respectively. The pressure when the enclosed $InI_3$ is entirely evaporated is represented by TP ($InI_3$). Similarly, the pressures when all the enclosed TlI, $ScI_3$, and NaI have been evaporated are represented by TP (TlI), TP ($ScI_3$) and TP (NaI), respectively. The actual pressure of $InI_3$ during steady-state operation is represented by P ($InI_3$). Similarly, the actual pressures of TlI, $ScI_3$, and NaI are represented by P (TlI), P ($ScI_3$) and P (NaI), respectively. In this case, for example, regarding $InI_3$, VP ($InI_3$)>TP ($InI_3$) results in P ($InI_3$)=TP ($InI_3$), and VP ($InI_3$) TP ($InI_3$) results in P ($InI_3$)=VP ($InI_3$).

Herein, VP ($InI_3$) is about 10.8 MPa. This vapor pressure was calculated based on the data on the vapor pressure of the metal halides listed in a catalogue of APL Co. (Illinois, USA).

Next, TP ($InI_3$) will be calculated. TP($InI_3$)=nRT/V is calculated from an equation of state of gas PV=nRT. Regarding $InI_3$ of the lamp 1 in Table 1, n1=$0.2\times10^6$ (mol), R=0.082, T=1173 (K), V=$0.025\times10^{-3}$ (L), and therefore TP($InI_3$)=0.08 (MPa). Therefore, since VP($InI_3$)>TP($InI_3$), P($InI_3$)=TP($InI_3$)=0.08 (MPa). Therefore, the number nt of halogen atoms is nt=PV/RT=0.2 (μmol).

From these results, the density of evaporated halogen (iodine of $InI_3$ in this case)=nt×3 (atomic value of halogen)/0.025 (cc) results in 24 (μmol /cc) from a calculation.

In the same manner as above, the density of halogen atoms of each enclosed material of TlI, $ScI_3$, and NaI is calculated. The total of these results is the density of halogen atoms evaporated during steady-state operation. Table 2 shows the density of halogen atoms obtained from calculations and the vapor pressure of each metal halide at 900° C. In Table 2, the upper line of each cell indicates the amount (μmol) of the evaporated metal halide 7, and the lower line indicates the density (μmol/cc) of the evaporated halogen atoms (I).

TABLE 2

| Lamp No. | 1 | 2 | 3 | 4 | 5 | 6 | 7 | Com. Ex. | Reference: vapor pressure (900° C.) (MPa) |
|---|---|---|---|---|---|---|---|---|---|
| $InI_3$(μmol) | 0.2 | 0.4 | 0.8 | 0.2 | | 0.1 | | | 10.8 |
| (μmol/cc) | 24 | 48 | 48 | 24 | | 12 | | | |
| InI(μmol) | | | | | 0.8 | | | 0.8 | 0.63 |
| (μmol/cc) | | | | | 32 | | | 32 | |
| TlI(μmol) | 0.3 | | 0.3 | 0.3 | | 0.2 | | | 0.13 |
| (μmol/cc) | 12 | | 12 | 12 | | 8 | | | |
| $ScI_3$(μmol) | 0.14 | 0.18 | 0.18 | 0.18 | 0.18 | | 0.14 | 0.1 | 0.08 |
| (μmol/cc) | 16.8 | 21.6 | 21.6 | 21.6 | 21.6 | | 16.8 | 21.6 | |
| NaI(μmol) | 0.3 | 0.005 | 0.005 | 0.005 | 0.005 | | 0.005 | 0.005 | 0.002 |
| (μmol/cc) | 12 | 0.2 | 0.2 | 0.2 | 0.2 | | 0.2 | 0.2 | |
| Total evaporated halogen | | | | | | | | | |

TABLE 2-continued

| Lamp No. | 1 | 2 | 3 | 4 | 5 | 6 | 7 | Com. Ex. | Reference: vapor pressure (900° C.) (MPa) |
|---|---|---|---|---|---|---|---|---|---|
| (μmol) | 0.94 | 0.585 | 1.285 | 0.685 | 0.985 | 0.3 | 0.145 | 0.905 | |
| (μmol/cc) | 64.8 | 69.8 | 81.8 | 57.8 | 53.8 | 20 | 17 | 53.8 | |

Figure 3:
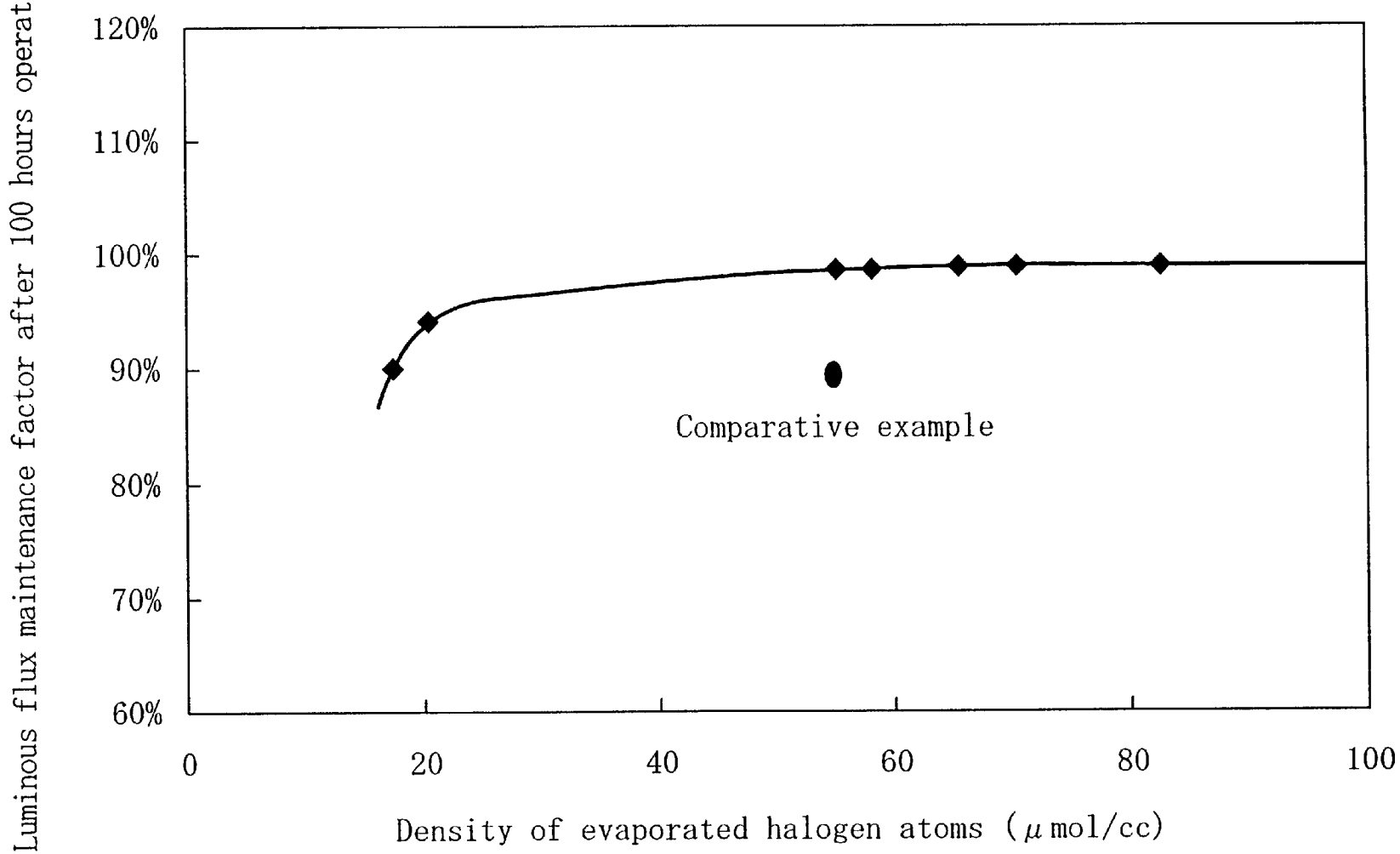
FIG. 3 is a graph showing the relationship between the density of evaporated halogen atoms and the luminous flux maintenance factor after 100 hours operation.

Next, the relationship between the density of evaporated halogen atoms and the luminous flux maintenance factor after 100 hours operation was investigated. FIG. 3 shows the results. The results shown in FIG. 3 were obtained by operating the lamps of this embodiment (lamps 1 to 7) and the lamp of the comparative example at a rectangular wave at a rated power of 35 W and an operating frequency of 150 Hz, and performing life tests with about 20 repetitions of turning on and off at an irregular cycle for 120 minutes to measure the luminous flux maintenance factor after 100 hours operation. The diamond marks indicate the results of lamps 1 to 7, and the solid circle indicates the result of the comparative example.

As seen from FIG. 3, the lamps having a density of evaporated halogen atoms of 20 μmol/cc or more (metal halide lamps of lamps 1 to 6) exhibited a luminous flux maintenance factor after 100 hours operation of 95% or more. In other words, lamps having reduced blackening can be obtained by defining the density of evaporated halogen atoms to be 20 μmol/cc or more.

FIG. 3 also indicates that when the density of evaporated halogen atoms is increased, blackening is further reduced, and the luminous flux maintenance factor can be kept good. Surprisingly, a lamp having a luminous flux maintenance factor of 100% and almost no blackening can be obtained by defining the density of evaporated atom density to be 50 μmol/cc or more.

Furthermore, when the arc tubes 1 of the lamps were visually observed, in the lamps having a density of evaporated halogen atoms of 20 μmol/cc or more (lamps 1 to 6) of the mercury-free metal halide lamps, blackening was not observed. On the other hand, in the lamp of the comparative example that contains mercury and to which a magnetic field is not applied, although the density of evaporated halogen atoms was 54 μmol/cc, which is not less than 20 μmol/cc, the luminous flux maintenance factor was 90%, and blackening was observed on the surface of the arc tube 1. Even if a lamp contains no mercury and a magnetic field is applied to the lamp, in the case of a lamp (lamp 7) having a density of evaporated halogen atoms of 17 μmol/cc, which is less than 20 μmol/cc, the luminous flux maintenance factor was 90%, and blackening was observed on the surface of the arc tube 1, as the lamp of the comparative example.

As described above, in the metal halide lamps that contain no mercury, when the density of evaporated halogen atoms with respect to the inner volume of the arc tube 1 during steady-state operation is 20 μmol/cc or more, mercury-free metal halide lamps with reduced blackening can be obtained. It is very significant to suppress blackening in the mercury-free metal halide lamps. More specifically, in the mercury-free metal halide lamp, because mercury is not enclosed, the lamp voltage tends to be lowered and the lamp current tends to be increased. With this increase in the lamp current, evaporation of W from the tungsten electrodes 3 increases, so that blackening readily occurs and proceeds. Therefore, it is very significant for practical use of the mercury-free metal halide lamps that blackening can be suppressed from occurring and proceeding.

Furthermore, since means 8 for applying a magnetic field 9 to the arc formed between the electrode heads is provided, even if the lamp is operated such that the straight line connecting the electrode heads is substantially horizontal, arc curving can be suppressed and devitrification of the arc tube 1 or the like can be prevented. In other words, since the magnetic field 9 having a component oriented substantially in the vertically upward direction (or vertically downward direction) is applied to the arc by the means 8 for applying a magnetic field, the arc curving or the like that can be observed during operation of the mercury-free metal halide lamps can be suppressed.

In the mercury-free metal halide lamps having a density of evaporated halogen atoms of 20 μmol/cc or more, the luminous flux maintenance factor after 100 hours operation was good and blackening was not observed for the following reason, according to the inference of the inventors of the present invention.

All conventional general metal halide lamps (e.g., the lamp of the comparative example) contain mercury. However, mercury has a property of bonding to halogen generated from metal halide, so that the mercury may interfere with satisfactory halogen cycle. Halogen cycle is a phenomenon for returning W (tungsten) evaporated from the tungsten electrodes (3) during lamp operation to the tungsten electrodes (3) again with halogen as a medium. Therefore, when the halogen cycle is interfered with by the mercury, the W is attached to the tube wall of the arc tube 1, resulting in blackening, which can proceed. The lamp of this embodiment contains no mercury, so that a larger amount of free halogen atoms are present in the arc tube 1 than that in the comparative example, and therefore the halogen cycle can be activated more satisfactorily than in the lamp of the comparative example. Thus, it is possible to reduce blackening. This inference seems right basically in view of the results (see FIG. 3) that the mercury-free lamps having a large density of halogen atoms (e.g., 50 μmol/cc or more) have better luminous flux maintenance factor after 100 hours operation than those of the mercury-free lamps having a small density of halogen atoms.

It has been described above that the characteristics of the mercury-free halide lamps can be improved by increasing the density of halogen atoms. However, a lamp having such a long life cannot be obtained simply by removing mercury from a metal halide lamp containing mercury to make it a mercury-free metal halide lamp. When the mercury-free metal halide lamp is horizontally operated, the arc curves upward, and the arc is in contact with an upper portion of the arc tube 1. Consequently, devitrification of the upper portion of the lamp or swell of the arc tube 1 is caused, resulting in a significantly short life of the lamp. In order to solve this problem, it is necessary to apply a magnetic field 9 to the arc. Applying the magnetic field 9 makes it possible to avoid shortening the life due to the arc curving and achieve a long life of the lamp. The luminous flux maintenance factor shown in FIG. 3 is surprisingly high in the current mercury-free metal halide lamps. As described above, when the technique disclosed in Japanese Patent Application No. 2001-155385 (Applicant; Matsushita Electric Industrial Co., Ltd.) is applied hereto, not only arc curving, but also arc vibration can be suppressed.

The technique disclosed in this publication will be described briefly. The principle on which the arc curving in a mercury-free metal halide lamp can be suppressed by applying the magnetic field 9 is not very clear at present, but arc curving and arc vibration can be suppressed when the parameters that may affect arc curving and arc vibration in the mercury-free metal halide lamp are set so as to satisfy the relationship of the Equation 1 or 2.

$$0<(100\ BW/f)-P_0d<100 \quad \text{Equation 1}$$

$$0<(10\ BW/f)-Pd<10 \quad \text{Equation 2}$$

wherein B(mT) is the magnetic field (9) applied to a center between the heads of the pair of electrodes when the lamp is operated horizontally such that a straight line connecting the heads of the pair of electrodes (3, 3) is substantially horizontal, d(mm) is the distance between the heads of the pair of electrodes (3, 3), $P_0$(MPa) is the pressure inside the arc tube 1 during steady-state operation, W(W) is the power consumed during steady-state operation, and f(Hz) is the steady-state frequency during steady-state operation. P(MPa) in Equation 2 is the pressure of an enclosed rare gas at 20° C.

The meaning of each term of Equations 1 and 2 will be described briefly. The terms (100 BW/f) in Equation 1 and (10 BW/f) in Equation 2 are the terms of the downward force on the arc generated by the magnetic field 9, and the term $P_0d$ in Equation 1 and Pd in Equation 2 are the terms of the upward force (buoyancy) on the arc generated by the convection current of the gas in the arc tube. The downward force on the arc can balance with the upward force by satisfying the relationship of Equation 1 or 2.

Because of the fact that the pressure P of the enclosed rare gas can be measured more easily than the operating pressure $P_0$ and because there is no particular problem in defining the configuration, not with the operating pressure $P_0$, but with the pressure P of the enclosed rare gas, it is much more advantageous for the lamp design to define the configuration according to Equation 2. In Equation 2, more preferable conditions are as follows. It is preferable that P satisfies 0.1 (MPa)<P<2.5 (MPa). It is preferable that P·d satisfies P·d<8 (more preferably Pd≦4.6). Moreover, it is preferable that f satisfies 40 (Hz)<f. It is preferable that B satisfies B<500 (mT). It is preferable that d satisfies 2<d(mm).

Figure 4:
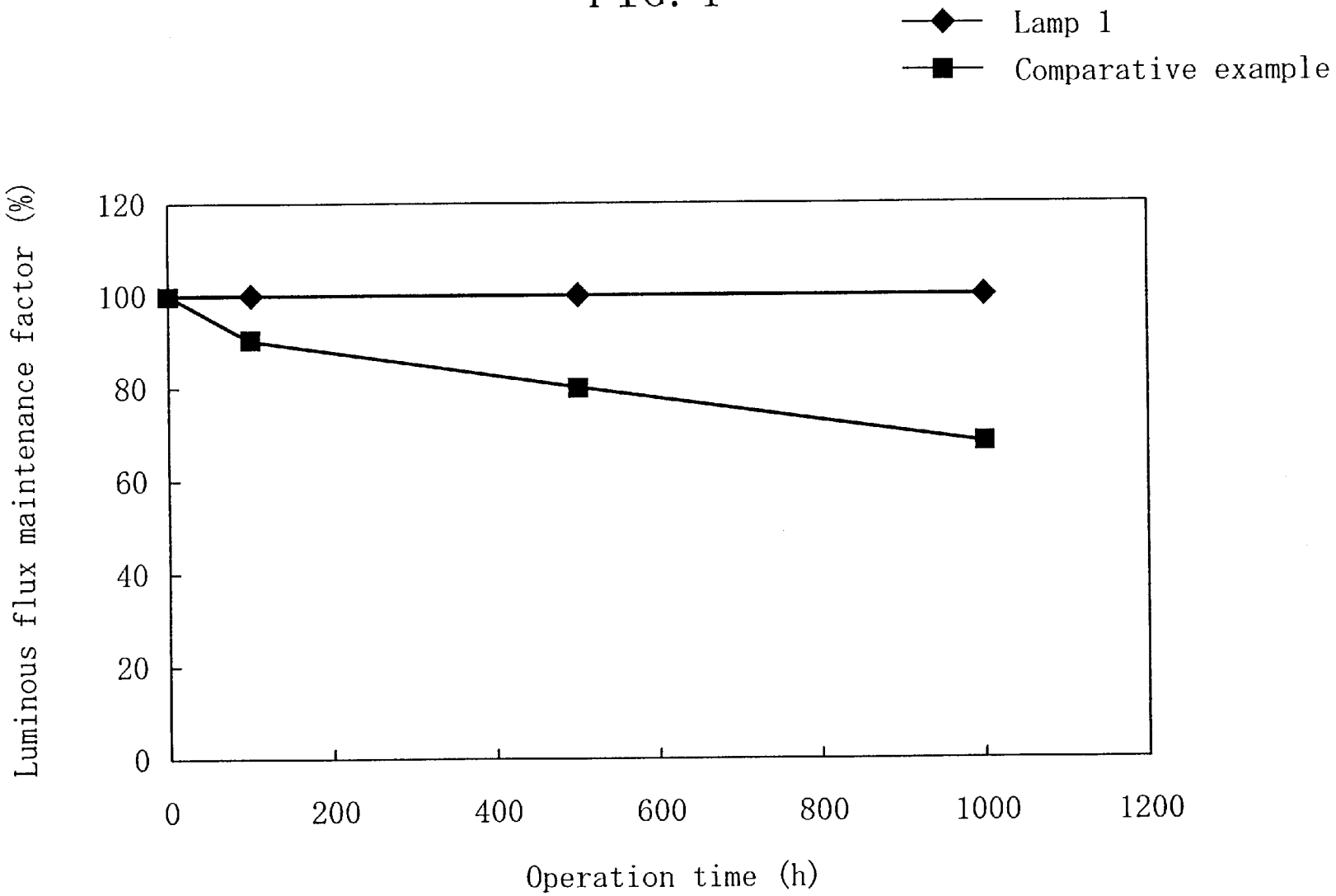
FIG. 4 is a graph showing the relationship between the operation time of the lamp and the luminous flux maintenance factor.

The inventors of the present invention confirmed that the lamps 1 to 6 can maintain a high luminous flux maintenance factor over a long period. FIG. 4 shows the relationship between the operation time of the lamp and the luminous flux maintenance factor regarding the lamp 1 as an example.

As shown in FIG. 4, surprisingly, the luminous flux maintenance factor after 1000 hours operation was 100%, and visual observation confirmed that there was no blackening or devitrification. On the other hand, the luminous flux maintenance factor of the lamp of the comparative example was 70% (after 1000 hours operation). Furthermore, blackening and devitrification proceeded to such a large extent that the electrodes 3 in the arc tube 1 were seen only slightly. Thus, the lamp of this embodiment can attain a longer life than that of the lamp of the comparative example. The lamp of the comparative example is a metal halide lamp having a long life for a conventional lamp in which it was attempted to prevent blackening by adding metal Sc in an amount of 1 to 5 wt % (3 wt % in this case) with respect to $ScI_3$. Therefore, it is surprising by the standard of the state of the art that the mercury-free metal halide lamp that would have a very short life without using the technique of this embodiment can have a longer life than that of the conventional mercury lamp (comparative example) in which it was attempted to achieve a long life.

As seen from FIG. 3, when the density of evaporated halogen atoms is about 30 (μmol/cc) or more, the luminous flux maintenance factor after 100 hours operation is 97%. When the density of evaporated halogen atoms is about 40 (μmol/cc) or more, the luminous flux maintenance factor after 100 hours operation is 98%, which is more preferable.

In this embodiment, a halide (e.g., $InI_3$ or the like) is enclosed, but not only a halide, but also a single substance of halogen (e.g., $I_2$ (iodine)) can be enclosed. Iodine has a higher vapor pressure than that of a general metal halide that is enclosed in a metal halide lamp, and therefore iodine is more preferable. For example, when $I_2$ is enclosed in an amount of 20 μmol/cc, the iodine is entirely evaporated at 900° C., which is a design temperature of a general metal halide lamp, and therefore the density of iodine atoms is 40 μmol/cc at this time.

In order to realize the density of halogen atoms providing good lamp characteristics as described above, it is preferable that metal halogen molecules enclosed per inner volume of the arc tube 1 is substantially 20 μmol/cc or more. This is preferable for the following reason.

When the lamp is operated for a long time, a metal halide reacts with quartz glass, slips into the bases of the electrodes, or reacts with impurities in the arc tube, for example. Thus, the amount of the metal halide is reduced during operation. Therefore, in order to obtain at least 20 μmol/cc of evaporated halogen atoms, it is preferable that the amount of the metal halogen molecules per inner volume of the arc tube is 20 μmol/cc or more. More preferably, the above-described effects can be retained for an even longer period by defining the amount of metal halogen molecules to 30 μmol/cc or more. It is desirable that the amount is 40 μmol/cc or more, more desirably, 50 μmol/cc or more, and even more desirably, 60 μmol/cc or more.

Although the more metal halide or halogen single substance enclosed may be better on principle, if it is too much more than necessary, the ascent of the enclosed material 7 that is not evaporated may occur. The upper limit of the metal halide to be enclosed can be determined by considering avoiding this problem of the ascent of the enclosed material. The upper limit of the total amount (C/V) of metal halide enclosed in the arc tube per inner volume is substantially 120 μmol/cc, and preferably not more than 120 μmol/cc. This is preferable for the following reason.

Figure 5:
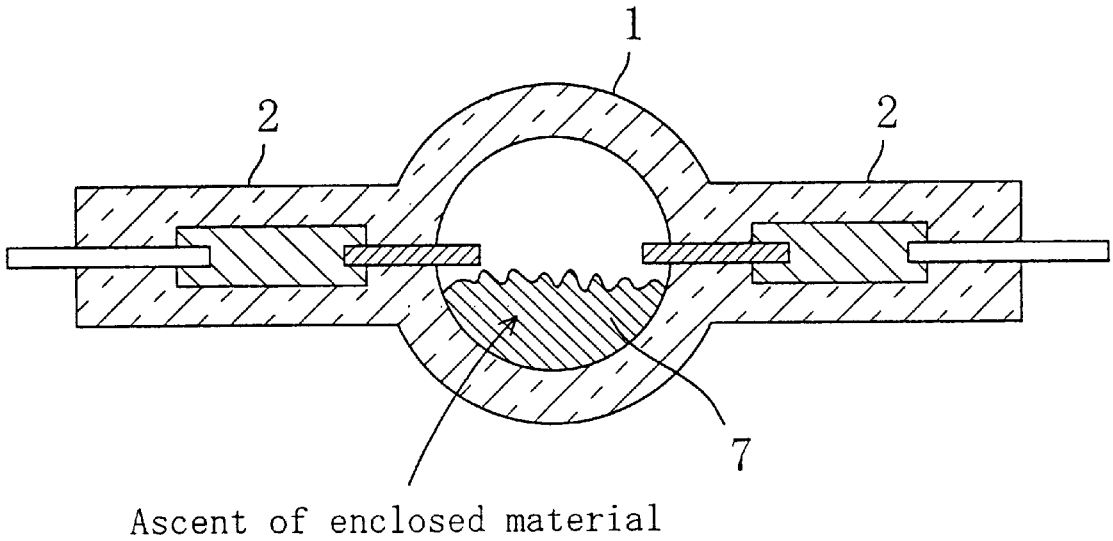
FIG. 5 is a schematic cross-sectional view showing the ascent of the enclosed material 7 in the lamp.

When a large amount of enclosed material 7 is being filled in the arc tube 1, the enclosed material 7 is accumulated in the arc tube 1, and this accumulation ascends along the inner surface of the arc tube 1. FIG. 5 shows the manner in which the enclosed material 7 is ascending. As understood from FIG. 5, the inner surface of the lower portion of the arc tube 1 is covered with the ascending enclosed material 7, and a part of the arc light fails to come out from the arc tube 1.

Figure 6:
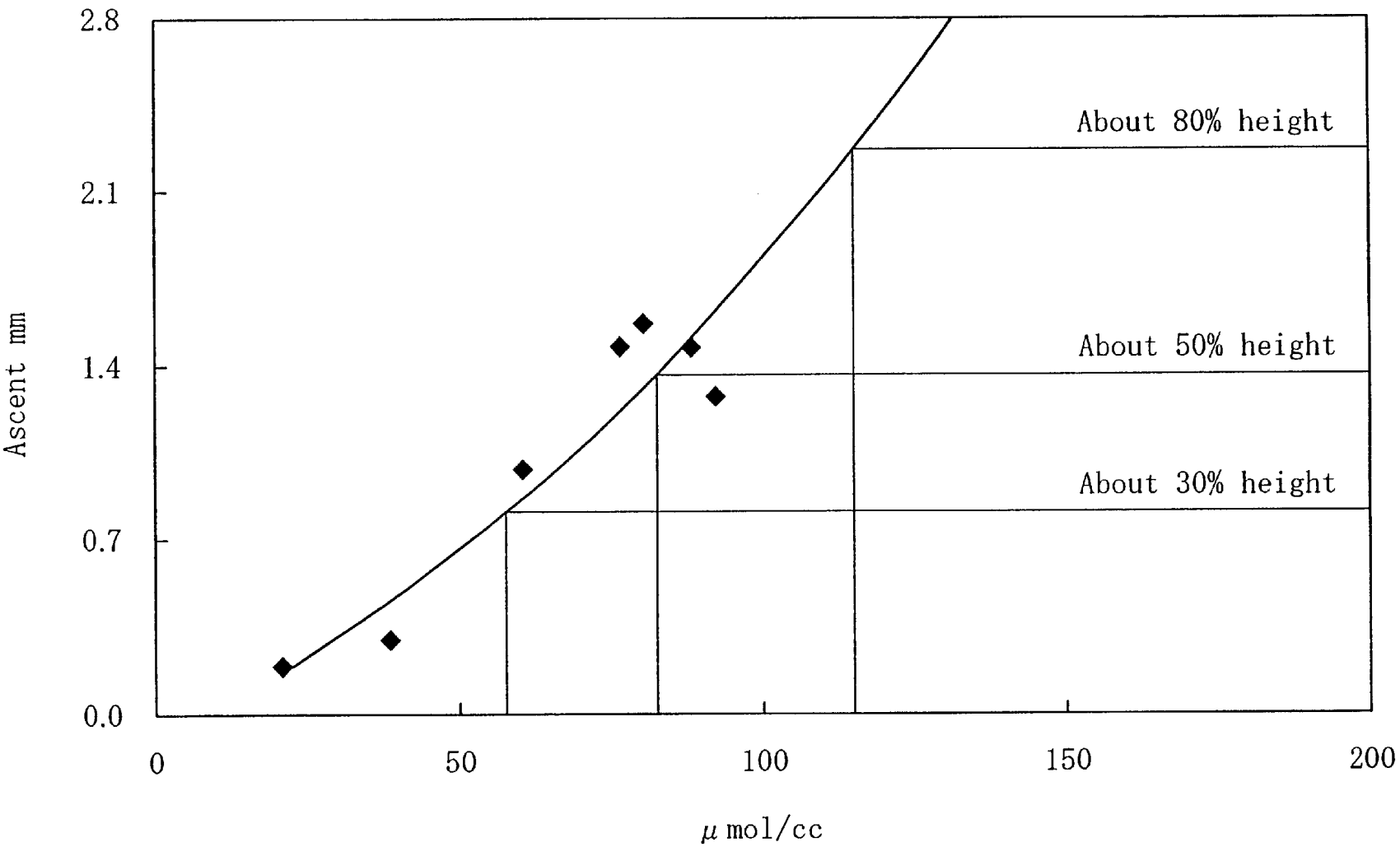
FIG. 6 is a graph showing the relationship between the amount of enclosed halide per inner volume of the lamp and the height of the ascent of the enclosed material in the arc tube.
Figure 7:
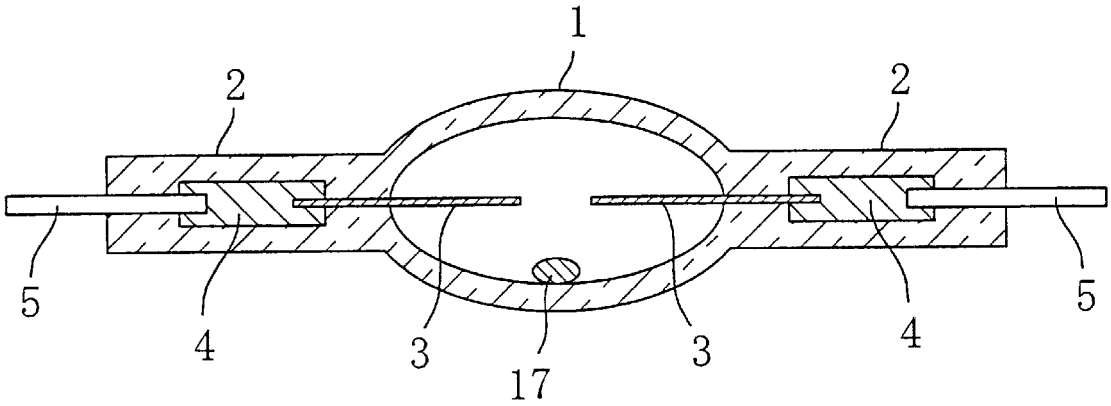
FIG. 7 is a schematic cross-sectional view of the configuration of a conventional metal halide lamp.

FIG. 6 shows the relationship between the amount of enclosed material per inner volume of the arc tube (i.e., C/V) and the height of the ascent of the enclosed material accumulation in the arc tube 1.

In the case of the arc tube 1 having an inner diameter of 2.8 mm used in this embodiment, as shown in FIG. 6, when the C/V is 120 μmol/cc or more, the height of the ascent of the enclosed material 7 accounts for about 80% of the height of the arc tube 1. In this case, most of the emission from the arc is affected by the accumulation, so that the luminous flux is reduced by about 50%. Therefore, it is preferable that the enclosed material 7 is not more than 120 μmol/cc. As seen from FIG. 6, the smaller extent of the ascent of the enclosed material 7 is more preferable. For example, when the amount is not more than 80 μmol/cc, the ascent of the enclosed material 7 is about a half of the height of the arc tube, and the luminous flux is reduced by about 10%, which does not cause a problem for practical use. When the amount is not more than 60 μmol/cc, the ascent of the enclosed material 7 is about 30% of the height of the arc tube, and the luminous flux is reduced by about 1% or less, which causes no problem at all for practical use.

It is preferable that the current density in the electrode heads: $I/\Phi^2$ ($A/mm^2$) is not less than 5 ($A/mm^2$) and not more than 20 $A/mm^2$. A lamp with little blackening and no flickering can be obtained by setting the current density in the range from 5 $A/mm^2$ to 20 $A/mm^2$. More specifically, when the current density is more than 20 $A/mm^2$, the current density in the electrode heads becomes high, so that the temperature of the electrode heads is increased excessively. As a result, evaporation from the electrodes occurs more significantly, so that blackening is facilitated. On the other hand, when the current density is lower than 5 $A/mm^2$, the temperature of the electrodes is too low to keep discharge stable, and therefore a luminescent spot is moved in the electrode heads, which may cause flickering. Thus, this it not preferable.

For realizing the halogen atom density, in the case of the rated power per unit inner surface area of the arc tube: A=50 ($W/cm^2$), the rated power: W=35 (W), the distance between the electrodes: d=about 4.2 (mm), and the inner diameter of the arc tube 1: D=about 2.7 (mm), it is preferable to satisfy 30 A 150 and 0.5 $W/D^2 \cdot d$ 2. This is preferable for the following reason.

The halogen atom density is determined by the vapor pressure and the amount of the metal halide 7, and the temperature at the place where the metal halide 7 is present. The temperature is one at the coolest point of the arc tube. The coolest point is generally in a lower portion on the center of the arc tube 1 when the lamp is horizontally operated. The temperature in this portion can be represented with A or $W/D^2 \cdot d$ in a simple manner. For example, when A is 30 $W/cm^2$ or less or $W/D^2 \cdot d$ is 0.5 or less, the temperature hardly reaches a temperature that allows sufficient evaporation of the halide. On the other hand, when A is 150 $W/cm^2$ or more or $W/D^2 \cdot d$ is 2 or more, the temperature becomes too high, so that devitrification of the arc tube is caused. Therefore, in order to obtain good emission characteristics of the lamp, it is preferable that A is about 50 to 100 $W/cm^2$ and 0.7 $W/D^2 \cdot d$ 1.5 is substantially satisfied.

In this embodiment, the direction of the magnetic field is vertically upward, but the direction is not limited thereto. The inventors of the present invention confirmed that the same effects can be obtained, as long as a vertically upward component or a vertically downward component is provided. In this embodiment, I (iodine) is used as the halogen, but the halogen is not limited thereto. The halogen may be Br (bromine), Cl (chlorine) or F (fluorine). Furthermore, in this embodiment, Xe gas is enclosed at 1.4 MPa, but the pressure is not limited thereto. The rare gas is not limited to Xe gas and, for example, an argon (Ar) gas can be used to operate the mercury-free metal halide lamp.

As a metal halide to be enclosed, a halide having a comparatively high vapor pressure in the vicinity of about 900° C., which is the temperature of the coolest point of the lamp is preferable. For example, InI, InBr, $InI_3$, TlI or the like is preferable. More specifically, in the case where the enclosed material includes a halide of In, it is preferable that the amount of the enclosed material is 4 μmol/cc or more. When the amount of the enclosed material is 4 μmol/cc or more, emission at wavelengths other than 410 and 450 nm, which are emission lines of In, can be increased, resulting in emission in the entire visible range of 400 to 800 nm and emission of substantially white light. Furthermore, for example, it is preferable that the amount of an enclosed material including a halide of Tl is 6 μmol/cc or more. When the amount of the enclosed material is 6 μmol/cc or more, emission at wavelengths other than 550 nm, which is the peak of the spectral luminous efficiency of the emission line of Tl, can be increased, resulting in improving luminous efficiency.

A permanent magnet (in particular, isotropic permanent magnet) is used as the means 8 for applying a magnetic field, but the effects of this embodiment can be obtained, regardless of the type of the magnet and the method for applying the magnetic field (e.g., electromagnet with a coil). The magnetic flux density is not limited to the values of the above embodiment, and can be selected suitably. In other words, since a suitable magnetic flux density is varied with the electrical characteristics, the distance between the electrodes, the rated power, the operating frequency, the type and the amount of the enclosed material, or the pressure of the enclosed gas of the metal halide lamp, a suitable magnetic flux density can be applied depending on the conditions of the metal halide lamp.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A mercury-free metal halide lamp comprising:

an arc tube including a pair of electrodes inside the tube, wherein in the arc tube, a rare gas and a metal halide are contained, and no mercury is contained, and the mercury-free metal halide lamp is horizontally operated such that the pair of electrodes is substantially horizontal, the mercury-free metal halide lamp further comprising magnetic field applying means for applying, in a substantially vertical direction, a magnetic field including a component substantially perpendicular to a straight line connecting heads of the pair of electrodes, wherein a density of halogen atoms evaporated during steady-state operation with respect to unit inner volume of the arc tube is 20 μmol/cc or more, the lamp satisfies the relationship of Equation, $0<(10BW/f)-Pd<10$ where B(mT) is the magnetic field applied to a center between the heads of the pair of electrodes when the lamp is operated horizontally such that a straight line connecting the heads of the pair of electrodes is substantially horizontal, d(mm) is the distance between the heads of the pair of electrodes, W(W) is the power consumed during steady-state operation, and f(Hz) is the steady-state frequency during steady-state operation, P(MPa) is the pressure of an enclosed rare gas at 20° C.

2. The mercury-free metal halide lamp according to claim 1, wherein the density of the halogen atoms is 40 μmol/cc or more.

3. The mercury-free metal halide lamp according to claim 1, wherein a total amount of the metal halide enclosed in the arc tube with respect to unit inner volume of the arc tube is 20 μmol/cc or more.

4. The mercury-free metal halide lamp according to claim 1, wherein a total amount of the metal halide enclosed in the arc tube with respect to unit inner volume of the arc tube is 120 μmol/cc or less.

5. The mercury-free metal halide lamp according to claim 1, wherein an operating current is a rectangular wave and the f satisfies 40 (Hz)<f.

* * * * *